US005662236A

United States Patent [19]

Sato

[11] Patent Number: 5,662,236

[45] Date of Patent: Sep. 2, 1997

[54] WATERPROOF CASE FOR A CONNECTOR

[75] Inventor: Kazuomi Sato, Tokyo, Japan

[73] Assignee: Japan Aviation Electronics Industry, Limited, Tokyo, Japan

[21] Appl. No.: 461,649

[22] Filed: Jun. 5, 1995

[30] Foreign Application Priority Data

Jun. 7, 1994 [JP] Japan ..... 6-125295

[51] Int. Cl.[6] ..... B65D 45/20

[52] U.S. Cl. ..... 220/324; 220/335; 220/343; 220/379; 439/142

[58] Field of Search ..... 439/142; 220/335, 220/324, 379, 342, 344, 343, 744, 4.22

[56] References Cited

U.S. PATENT DOCUMENTS

| | | | |
|---|---|---|---|
| 745,322 | 12/1903 | Burrough | 220/335 |
| 1,429,630 | 9/1922 | Rebideau | 220/744 |
| 3,383,009 | 5/1968 | Weikert | 220/342 |
| 3,402,846 | 9/1968 | Zerwes . | |
| 3,503,535 | 3/1970 | Sparks, Sr. | 220/744 |
| 4,306,601 | 12/1981 | Wallis et al. | 220/342 |
| 4,723,919 | 2/1988 | Crane . | |
| 4,915,913 | 4/1990 | Williams et al. | 220/324 X |
| 5,149,348 | 9/1992 | Bissinger | 220/344 X |
| 5,385,257 | 1/1995 | Hung | 220/344 |
| 5,423,419 | 6/1995 | Wentz et al. | 220/344 |

FOREIGN PATENT DOCUMENTS

| | | | |
|---|---|---|---|
| 695 256 | 12/1930 | France . | |
| 299550 | 11/1928 | United Kingdom | 220/342 |
| 357894 | 10/1931 | United Kingdom | 220/342 |

*Primary Examiner*—Allan N. Shoap
*Assistant Examiner*—Christopher J. McDonald
*Attorney, Agent, or Firm*—Laff, Whitesel, Conte & Saret, Ltd.

[57] ABSTRACT

In a waterproof case in which a hood (1) contains a connector (P) to prevent the connector from being exposed to water, a cap (4) is for closing an opening portion 10*a* of the hood and has an end which is rotatably held to the hood through a mounting linkage (5) so that the opening portion can be opened and closed one at a time. A lever (6) is rotatably mounted to the hood at an end thereof. A locking linkage (7) is rotatably mounted at an end thereof to an intermediate portion which is between both ends of the lever. When the lever is rotated by operating the other end with the other end of the locking linkage engaged with the other end of the cap in the state of closing the opening portion, the cap is kept to a condition in which the opening portion is closed.

6 Claims, 11 Drawing Sheets

WATERPROOF CASE FOR A CONNECTOR

BACKGROUND OF THE INVENTION

The present invention relates to a waterproof case for use in containing or enclosing a connector therein to prevent the connector from being exposed to water.

Generally, connectors are required not to be exposed to water such as rain when unconnected. Therefore, use is made of a waterproof case to carry out waterproof of the connector.

Such a waterproof case comprises a hood for use in containing a connector therein and a cap for sealing an opening portion of the hood. A sealing member such as an O-ring or packing is located along the periphery of the opening portion of the hood. When the opening portion of the hood is covered by the cap, the sealing member is pressed between the hood and the cap in a radial direction thereof to prevent the water from entering into the case. For preventing loss of the cap when removed from the hood, a chain or the like is connected between the hood and the cap.

However, handling of the connector is obstructed by the cap. This is because the cap is freely movable when removed from the hood. Furthermore, the cap is often lost because the chain or the like is easy to be broken when pulled by strong force.

When the cap is fitted over the opening portion of the hood, the sealing member is pressed in the radial direction. This requires relatively large force. Accordingly, the cap is not necessarily easy to fit over the opening portion or to remove therefrom. In addition, it is assumed that the cap does not fit positively over the opening of the hood. In this case, waterproofness may be insufficient.

SUMMARY OF THE INVENTION

It is therefore an object of the present invention to provide a waterproof case for a connector, which does not obstruct handling of the connector.

It is another object of this invention to provide a waterproof case of the type described, which is capable of surely preventing the connector from being exposed to water.

It is still another of this invention to provide a waterproof case of the type described, in which loss is not occur about a cap included in the waterproof case.

Other objects of this invention will become clear as the description proceeds.

According to the present invention, there is provided a waterproof case for preventing a connector from being exposed to water, comprising a hood having an opening portion for containing the connector therein and a cap for closing the opening portion. In the waterproof case, the cap has a first and a second end opposite to each other. The waterproof case comprises a cap mounting device connected to the cap and the hood for rotatably mounting the first end of the cap to the hood so that the opening portion is opened and closed one at a time with the cap being rotatably moved, and close-keeping means connected to at least one of the cap and the hood for engaging with the second end of the cap and with the hood to keep a condition in which the opening portion is closed with the cap.

DESCRIPTION OF THE PREFERRED EMBODIMENT

Figure 1:
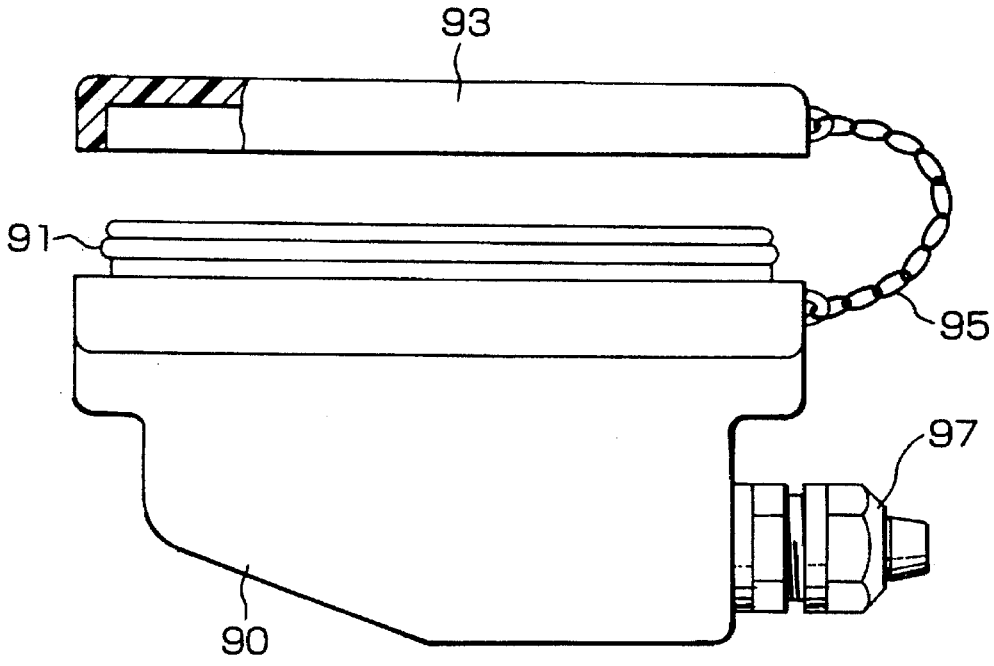
PRIOR ART FIG. 1
FIG. 1 is a partially cutaway front view of a conventional waterproof case for a connector, in which a cap is illustrated in an open state.
Figure 2:
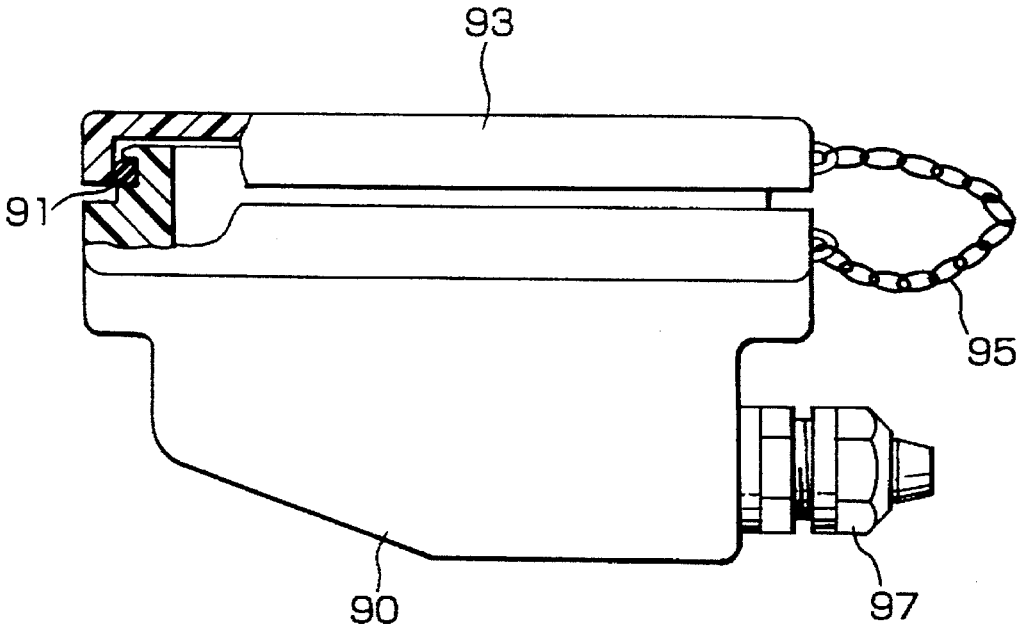
PRIOR ART FIG. 2
FIG. 2 is a partially cutaway front view of the waterproof case shown in FIG. 1, in which the cap is illustrated in a close state.

Referring to FIGS. 1 and 2, description will be made at first as regards a conventional waterproof case for a connector for a better understanding of the present invention. A sealing member such as an O-ring or packing is located along the periphery of an opening portion of a hood 90 for containing a connector inside thereof. When the cap 93 is covered over the opening portion of the hood 90, the sealing member 91 is pressed not to allow water to go through into the connector. The cap 93 is connected, by means of a chain 95 or the like, to the hood 90 not to be lost.

FIG. 1 shows the case, in which the cap 93 is illustrated in a taken-off state. In this state, the cap 93 can be moved freely. FIG. 2 shows the case, in which the cap 93 is covered over the opening portion of the hood 90. When the cap 93 is put over the opening portion, the cap goes into a predetermined position in slide contact with the sealing member 91.

However, in the conventional waterproof case, the hood 90 is connected to the cap 93 with the chain 95 or the like, allowing the cap 93 to move freely in handling (upon connecting or disconnecting the connector). This causes disadvantages of handling the connector. Furthermore, the chain 95 which connects the cap with the hood 90 is easy to be broken when the chain is pulled by force, and the cap 93 is often lost.

Further, the cap 93 is required to be pushed by hand when put over the opening portion of the hood 90. This requires a relatively large force and the cap 93 is thus not necessarily easy to mount or to remove. In addition, the cap 93 may not engage positively with the opening portion of the hood 90, providing only insufficient waterproofness.

Next, the description will be directed to a waterproof case according to an embodiment of the present invention. Referring to FIGS. 3 to 6, a hood 1 is box-shaped and made of a synthetic resin. The hood 1 comprises a housing 10 for use in containing the connector therein and an opening portion 10*a* opened in the upper side of the housing 10. A mounting hole (or an attaching screw hole) 11 is for receiving the connector and is formed in a bottom surface of the housing 10 as shown in FIG. 5. Further, the size of the opening portion 10*a* is determined depending on the size of the connector contained therein and on whether or not the hood 1 contains a mating receptacle connector.

An axial end surface of the opening portion 10*a* of the hood 1 is step-shaped such that the outer is lower and the inner is higher. A sealing member such as a rubber packing is located along this step-shaped edge of the opening portion 10*a*.

On a back face of the hood 1, a cap 4 is rotatably mounted to open and close the opening portion 10*a* of the hood 1 and seal the inside of the hood 1 in closing the opening portion 10*a*. In the waterproof case being exemplified, a rectangular frame-shaped mounting linkage 5 is used. The cap is rotatably mounted, at one end thereof, to the hood 1 by means of supporting both ends of the mounting linkage 5 with supporting pieces 15, 45 formed on the hood 1 and the cap 4, respectively (shown in FIG. 15). In other words, the mounting linkage 5 and the supporting pieces 15 and 45 form a cap mounting device.

A lever 6 is rotatably supported at one end thereof on the face, that is, the front face, opposing to the face where the mounting linkage 5 of the hood 1 is mounted. The rotating direction of the lever 6 is such a direction that the other end of the lever approaches to and separates from the opening portion of the hood 1. A locking linkage 7, comprising a part which extends parallel to the edge of the hood 1, is rotatably mounted at one end on an intermediate portion which is between both ends of the lever 6. The locking linkage 7 is engageable at the other end with a hook 41 formed on the other end of the cap 4. After the locking linkage 7 is engaged with the hook 41 of the cap 4, the cap is urged against the sealing member 3 in the direction parallel to the central axis of the opening portion 10*a* by the operation of the lever 6. The lever 6 is locked after the opening portion 10*a* is locked in a sealed state. The locked state is shown in FIGS. 7 to 10.

A pair of protrusions 16 is protruded from the sides of the hood 1 toward the back face of the hood 1. These protrusions 16 are for locking and holding the cap 4 from both sides, as shown in the figures, when the cap 4 is in an open state. With these protrusions, the cap 4 does not play but is locked to the hood 1. In other words, the protrusions 16 form cap holding means which holds the cap 4 to open the opening portion 10*a*. The number of the protrusions 16 is not limited to two, and the installation location is not limited to the illustrated location.

Figure 4:
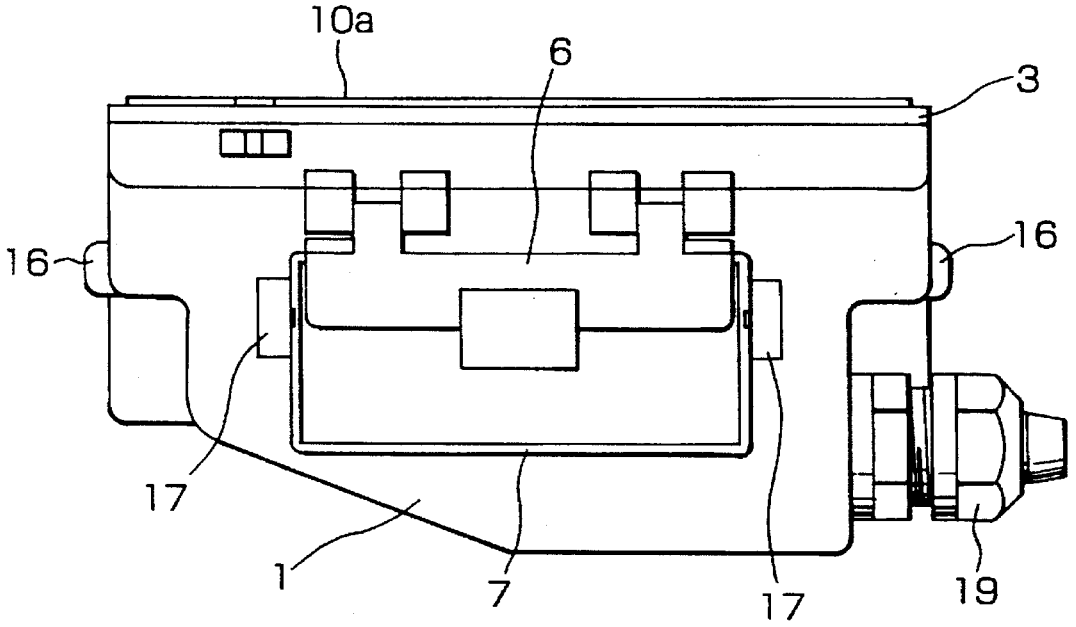
FIG. 4 is a front view of the waterproof case shown in FIG. 3.
Figure 5:
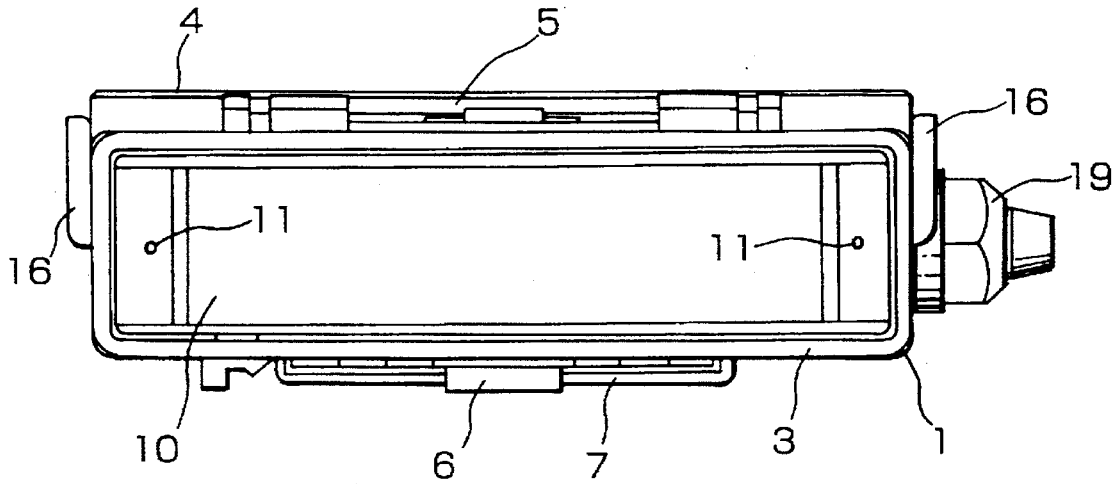
FIG. 5 is a plan view of the waterproof case shown in FIG. 3.
Figure 6:
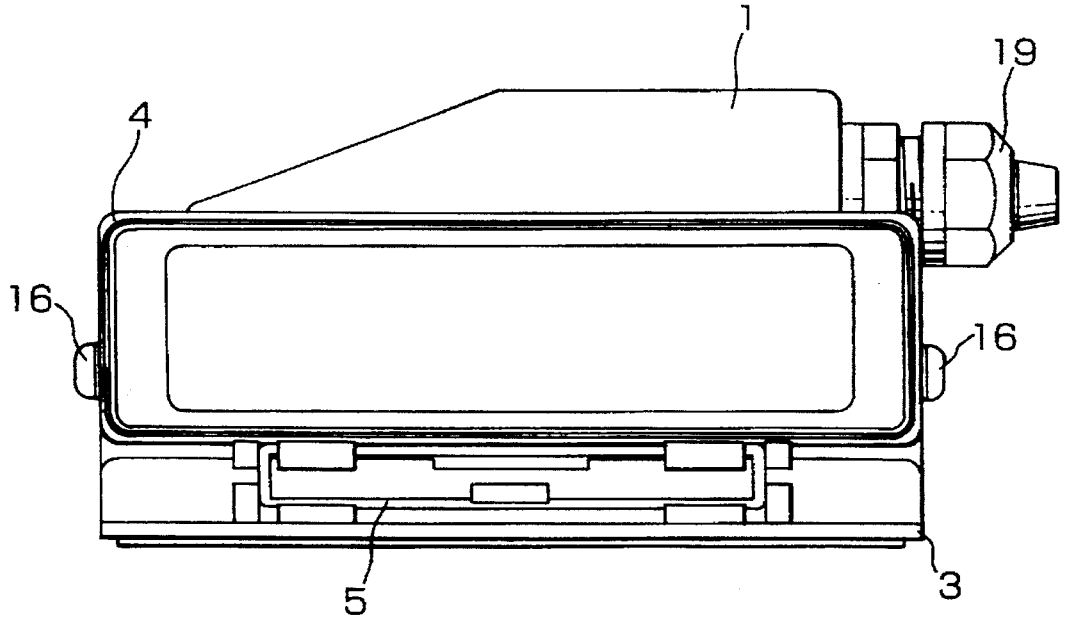
FIG. 6 is a rear view of the waterproof case shown in FIG. 3.
Figure 7:
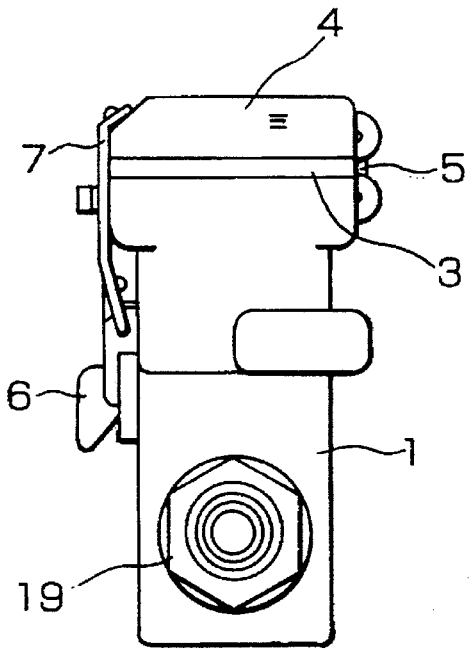
FIG. 7 is a side view of the waterproof case shown in FIG. 3, in which the cap is illustrated in a close state.
Figure 8:
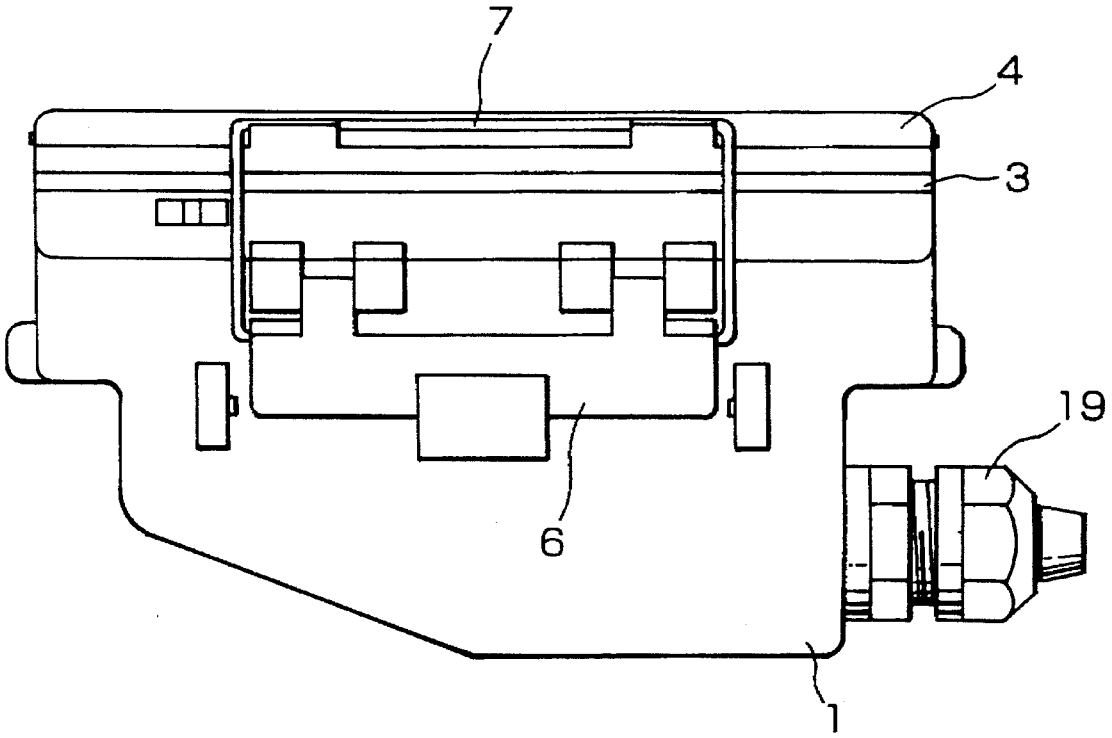
FIG. 8 is a front view of the waterproof case shown in FIG. 7.
Figure 9:
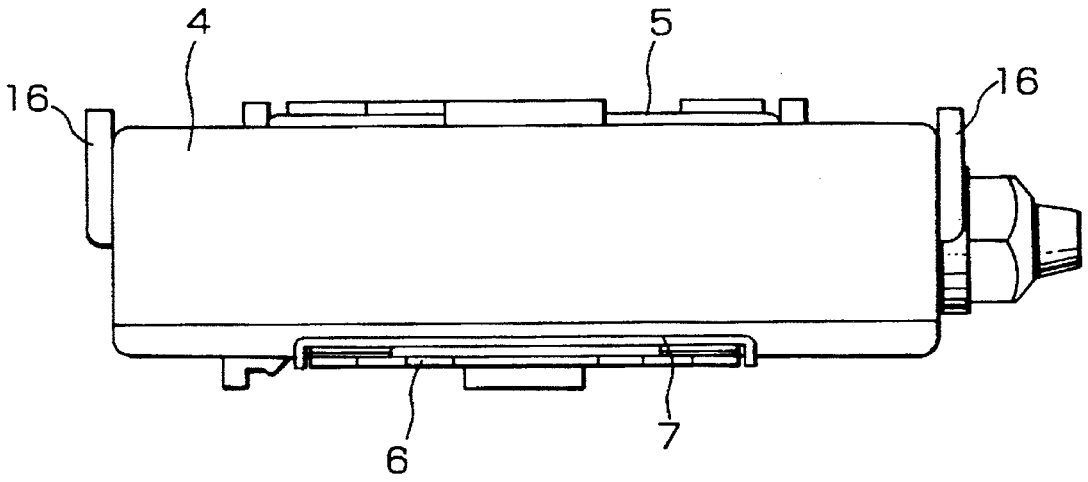
FIG. 9 is a plan view of the waterproof case shown in FIG. 7.
Figure 10:
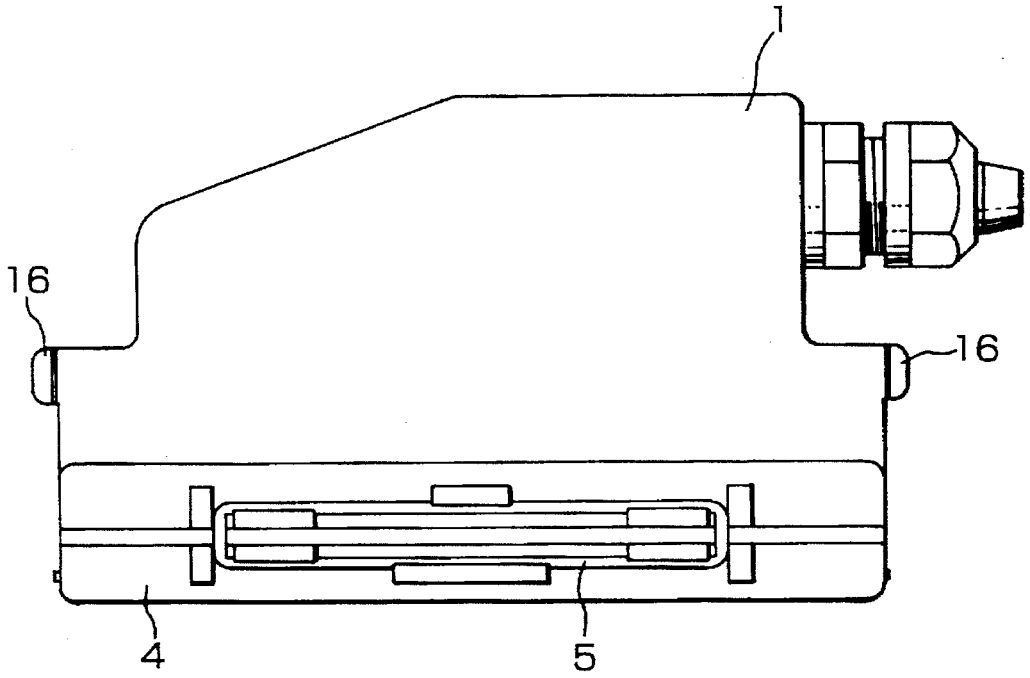
FIG. 10 is a rear view of the waterproof case shown in FIG. 7.
Figure 11:
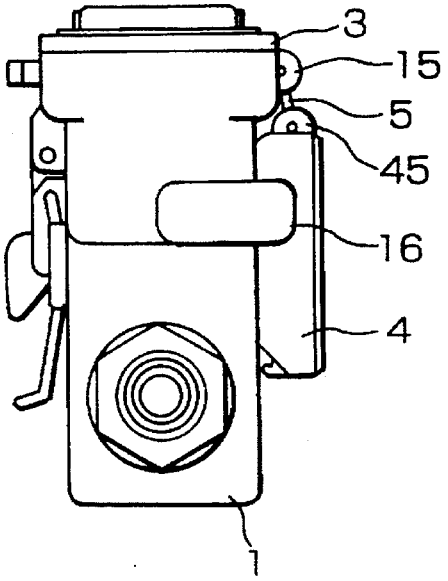
FIG. 11 is a side view of the waterproof case shown in FIG. 3, in which illustrated is the case containing a connector therein with the cap opened.
Figure 12:
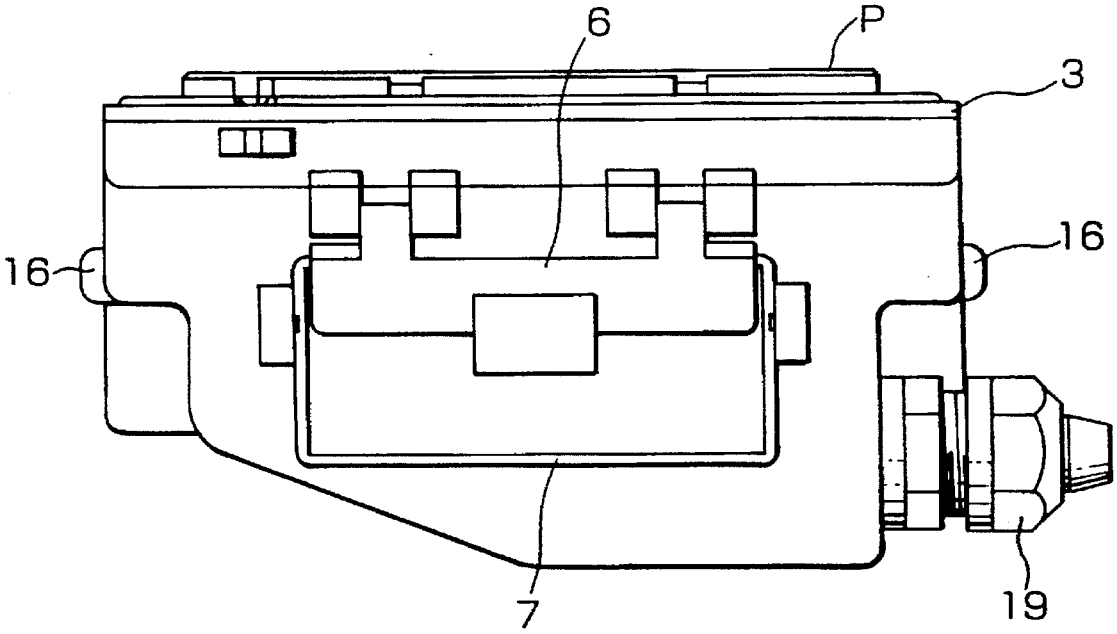
FIG. 12 is a front view of the waterproof case shown in FIG. 11.
Figure 13:
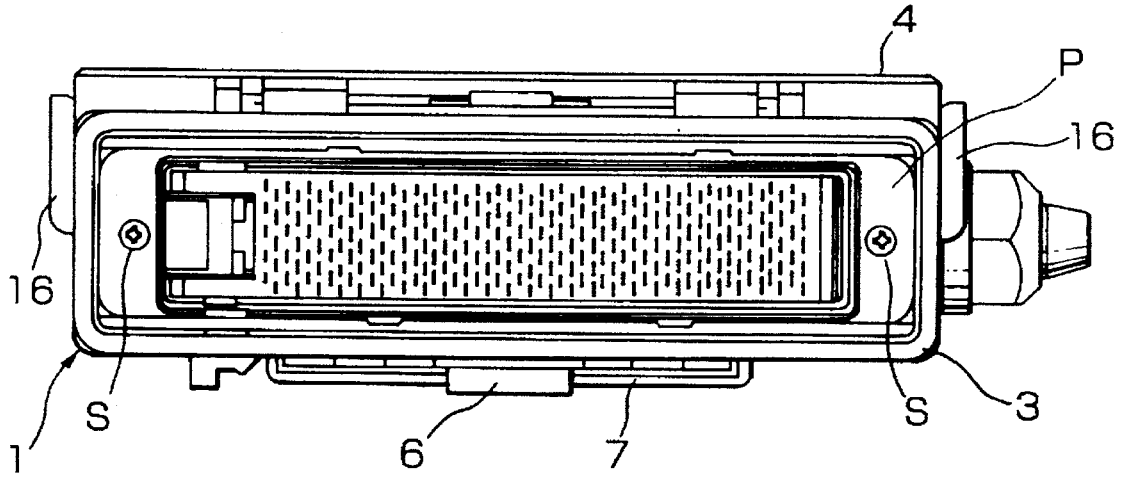
FIG. 13 is a plan view of the waterproof case shown in FIG. 11.
Figure 14:
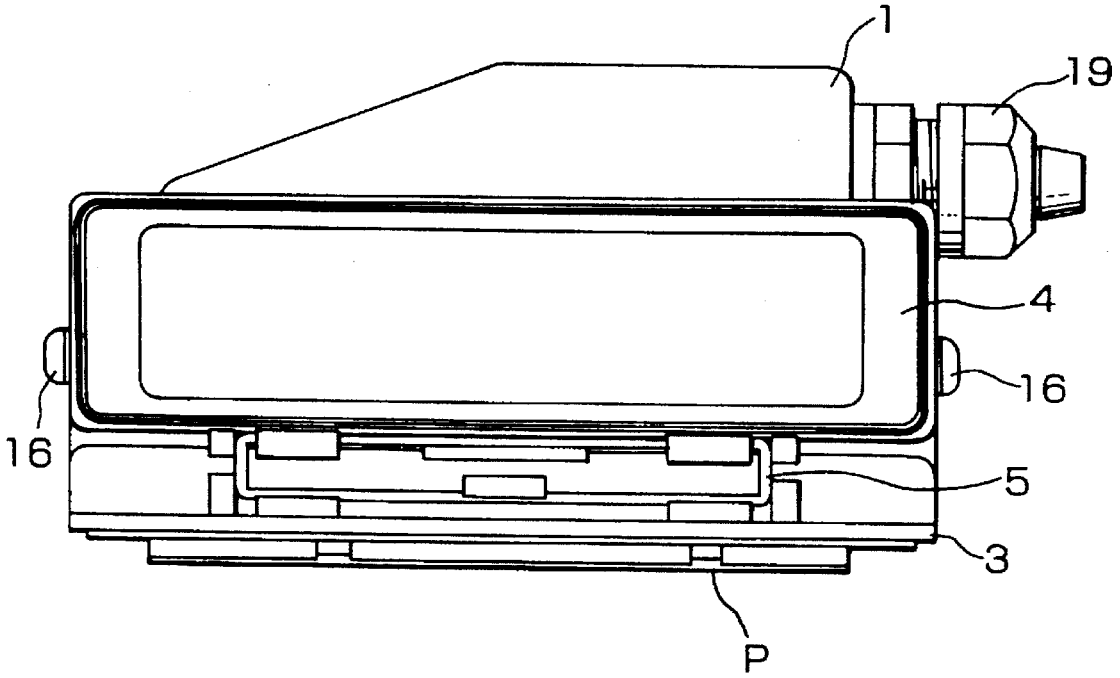
FIG. 14 is a rear view of the waterproof case shown in FIG. 11.

On the other hand, as shown in FIG. 4, a pair of locking protrusions 17 is formed to prevent the locking linkage 7 from playing. The number of the locking protrusions 17 is not also limited to two, and the installation location is not limited to the illustrated location. A reference numeral 19 indicates a cable clamp, which is an outlet for the cable of the connector contained in the hood 1, and has a waterproof function.

Figure 3:
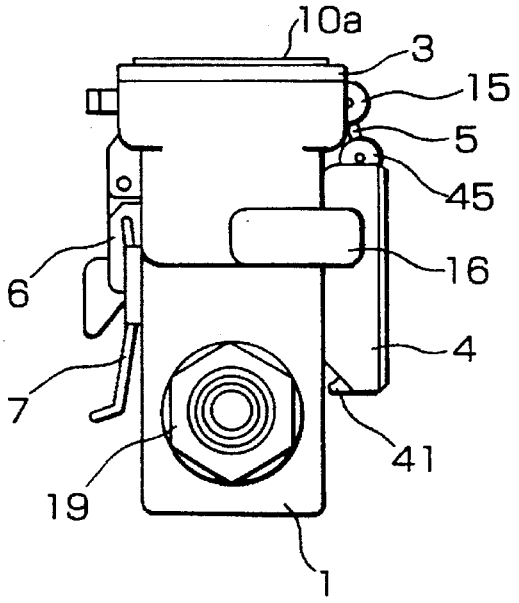
FIG. 3 is a side view of the waterproof case according to an embodiment of the present invention in which the cap is illustrated in an open state.

FIGS. 11 to 14 show the waterproof case shown in FIG. 3, in which a plug connector P is contained after opening portion the cap 4. The plug connector P is fixed to the hood 1 by screws S.

Figure 15:
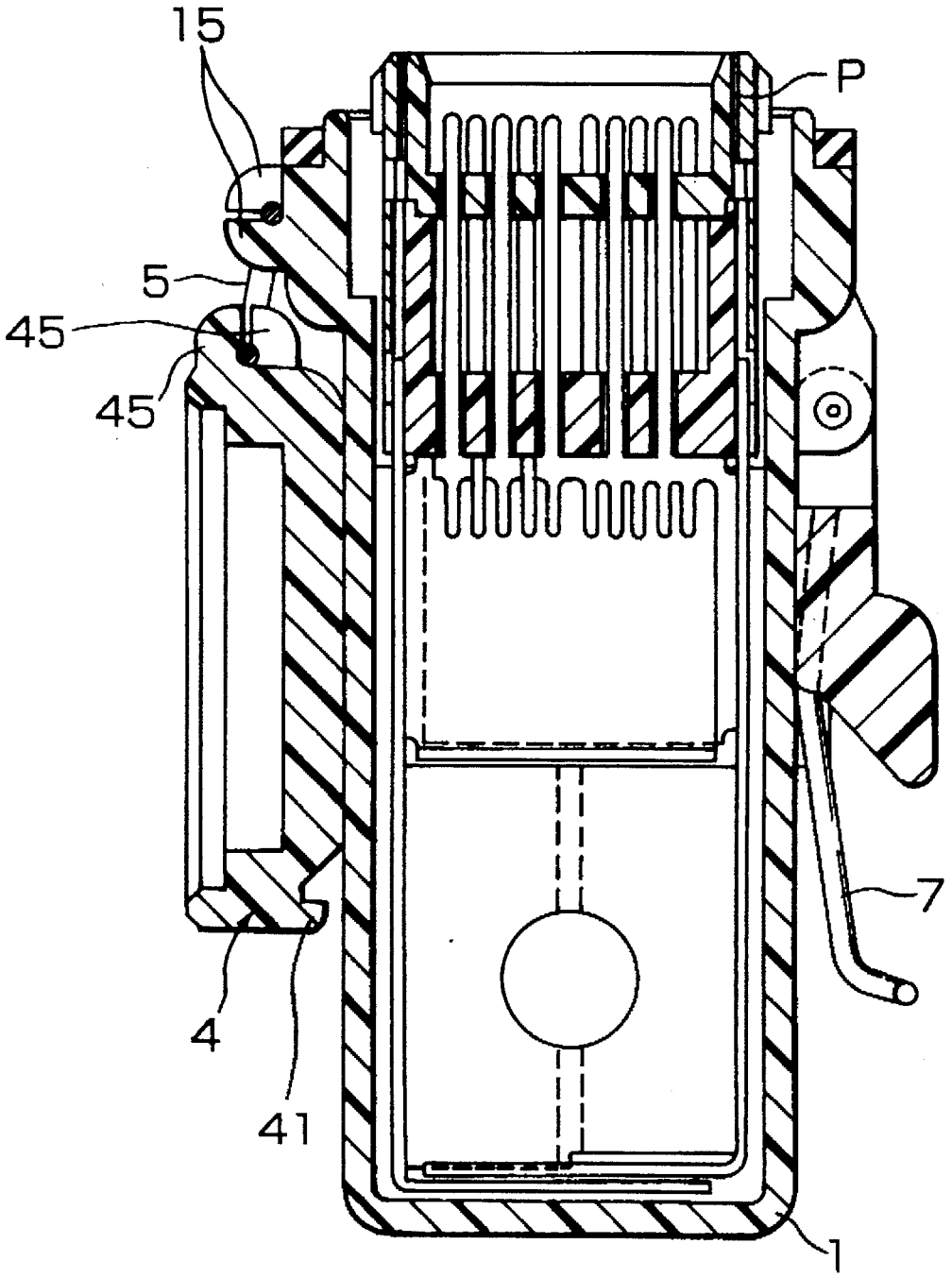
FIG. 15 is a vertical section of the waterproof case shown in FIG. 11.

Subsequently, an operation of closing the cap 4 in a state that the plug connector P is contained in the hood 1 will be described. Referring to FIG. 15 which shows that the cap 4 is full opened, the cap 4 is locked to the hood 1 by the protrusions 16. A plug connector P is capable of engaging and connecting with the mating receptacle connector.

Figure 16:
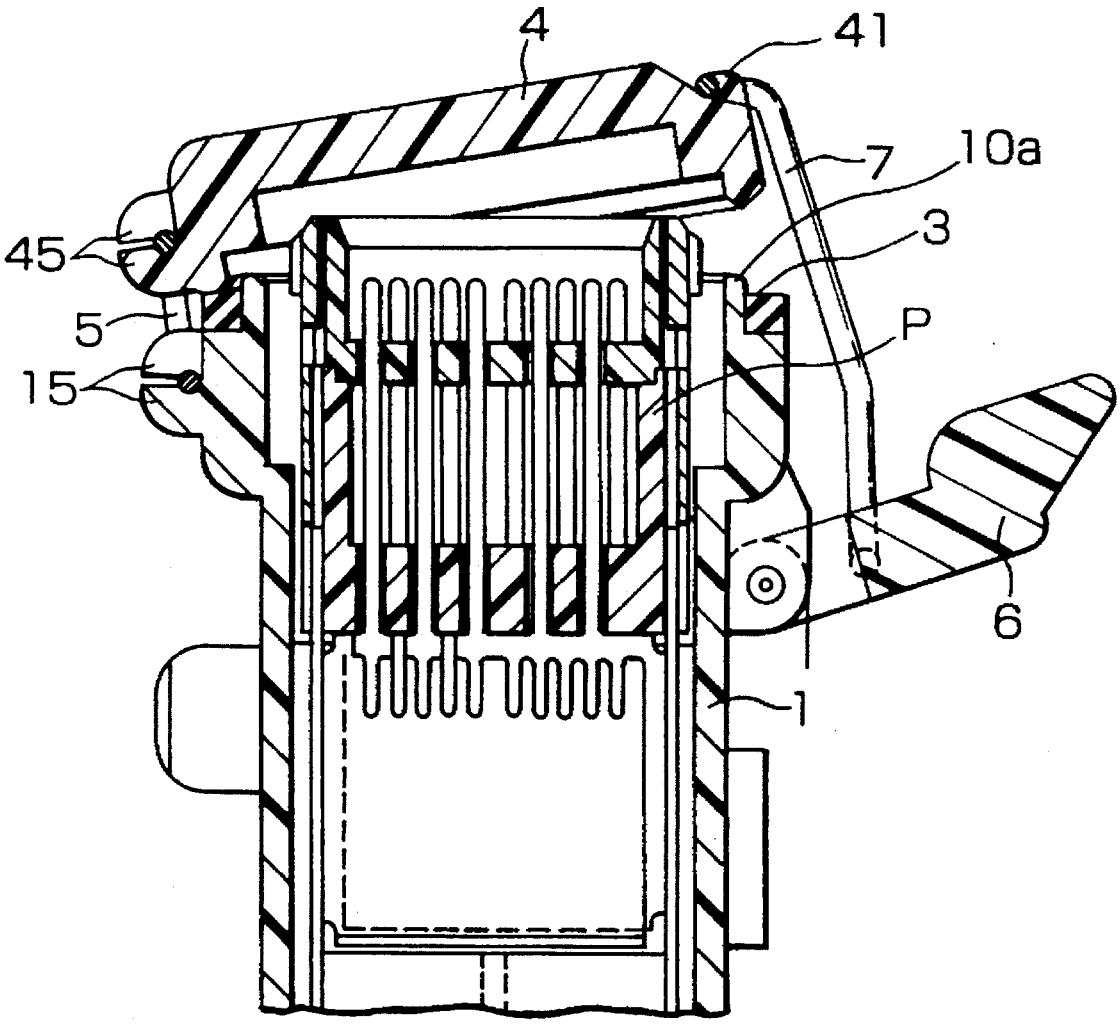
FIG. 16 is a vertical sectional view of the essentials of the waterproof case shown in FIG. 11, in which the case is illustrated in a half-closed state.
Figure 17:
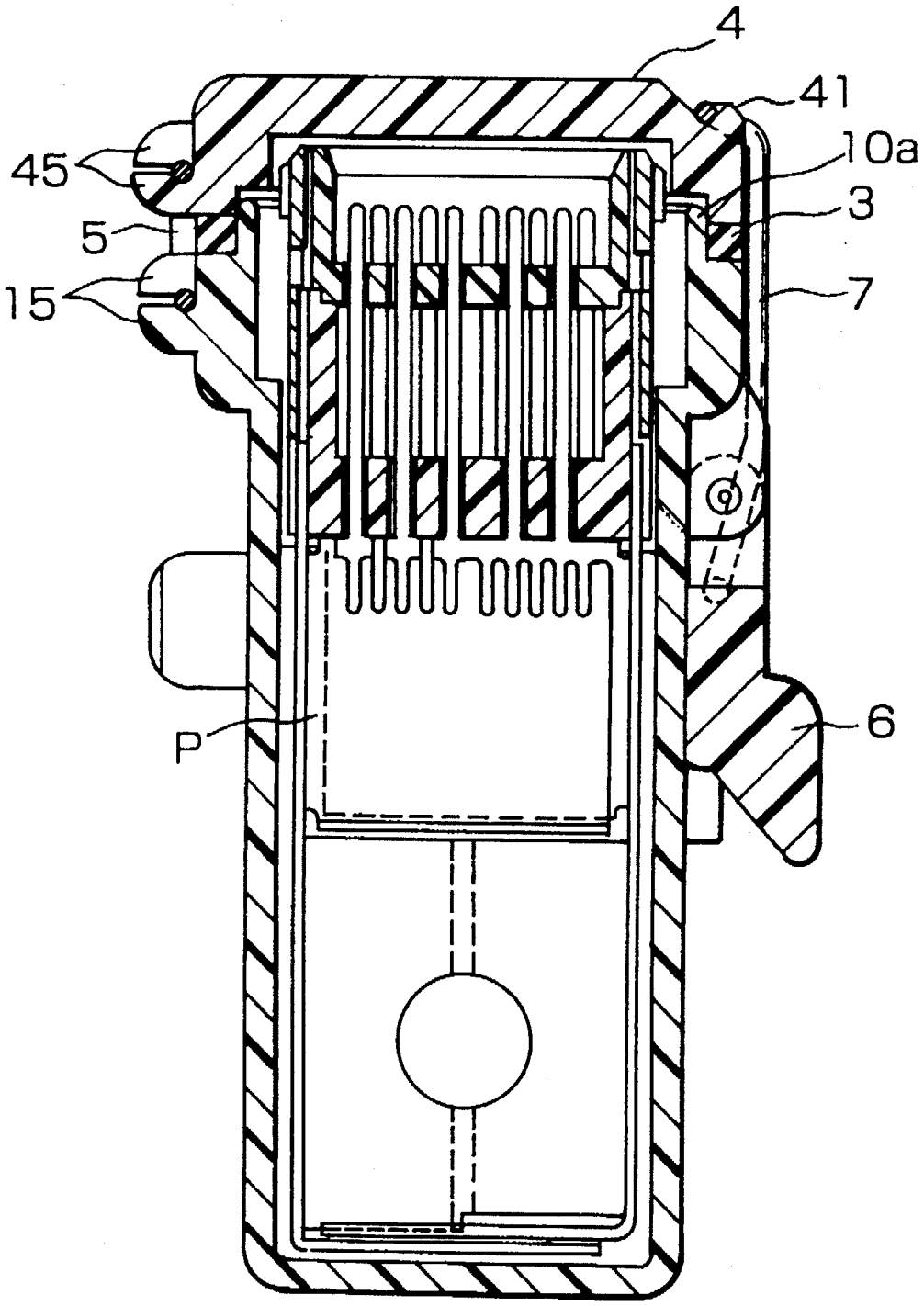
FIG. 17 is a vertical sectional view of the waterproof case shown in FIG. 11, in which the case is illustrated in a close state.

Referring to FIG. 16 which shows that the cap 4 is half-closed, the cap 4 is rotated in the direction of closing the lid about the linkage 5 as a pivotal center when closed. When the cap 4 is in a state of half-closing the lid, the lever 6 is once risen to the opening portion 10*a*, and the locking linkage 7 is hooked on the hook 41 of the cap 4. At this state, the lever 6 is backed to the original position (the farther from the opening portion 10*a*), and the cap 4 is urged against the sealing member 3 by a toggle mechanism and is covered over the opening portion 10*a* of the hood 1. This secures the watertightness inside of the case. At this time the cap 4 maintains the state of locking the opening portion 10*a*. A lock maintaining means consists of the lever 6, the locking linkage 7 and the hook 41.

As described above, when the cap 4 is in the state of half-closing the lid, the cap 4 is rotated about the lower end of the mounting linkage 5 supported by the supporting piece 15 of the hood 1. When the cap 4 is urged against the sealing member 3 by hooking the locking linkage 7 on the hook 41, the cap 4 is rotated about the upper end of the mounting linkage 5 supported by the supporting piece 45 of the cap 4. Therefore, the cap 4 is uniformly urged against the sealing member 3, and the watertightness is improved.

Figure 18:
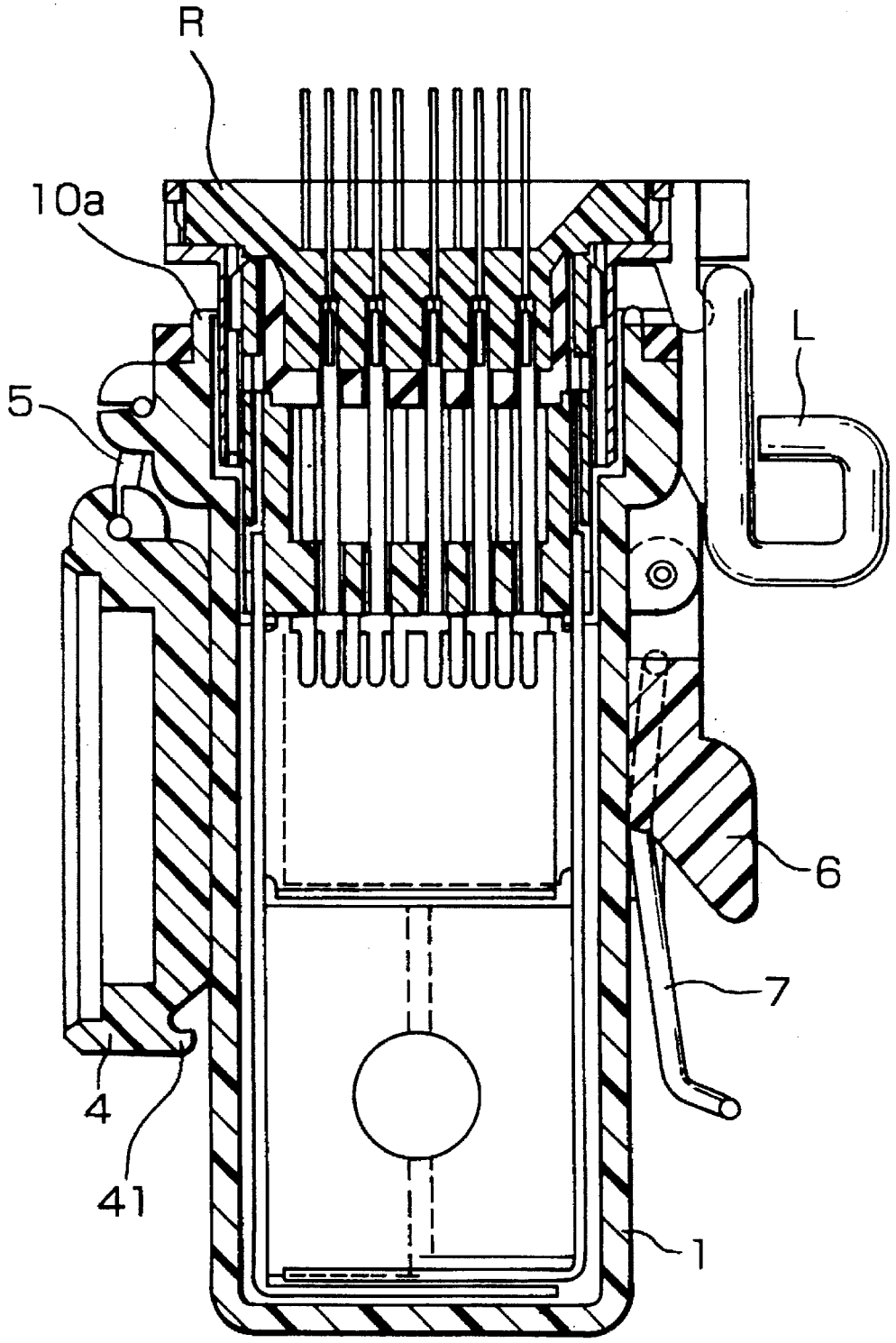
FIG. 18 is a vertical sectional view of the connector contained in the waterproof case shown in FIG. 11, in which the connector is connected with the other connector.

Referring to FIG. 18, in a state of connecting with the receptacle connector R as the other connector, an end of the receptacle connector R is accepted in the opening portion 10*a*. As described above, the cap 4 is rotatably mounted on the hood 1 using the mounting linkage 5, and the retracted position of the cap 4 can be kept at a distance from the opening portion 10*a* even when the opening portion 10*a* of the hood 1 is wide. Thus the connector waterproof case may be thinned. In FIG. 18, a reference numeral L indicates a connector driving lever for connecting and disconnecting the plug connector P with the receptacle connector L.

While the present invention has thus far been described in connection with a single embodiment thereof, it will readily be possible for those skilled in the art to put this invention into practice in various other manners. For example, a sealing member may be mounted on the cap side.

What is claimed is:

1. A waterproof case for preventing a connector from being exposed to water, said waterproof case comprising a hood having opposed sides and an opening portion for containing said connector therein and a cap for closing said opening portion, said cap having a first and a second end opposite to each other, said waterproof case further comprising:

a cap mounting device connected to said cap and said hood for rotatably mounting said first end of the cap to said hood so that said opening portion is opened and closed with said cap being rotatably moved; and close-keeping means connected to at least one of said cap and said hood for engaging with said second end of the cap and with the hood to keep a specific condition in which said opening portion is closed with said cap, said hood comprising cap holding means for holding said cap from both sides thereof to keep a particular condition in which said open portion is opened.

2. A waterproof case as claimed in claim 1, wherein said said close-keeping means comprises:

a lever having a first and a second end opposite to each other and an intermediate part between said first and said second end, said first end of the lever bing rotatably held on said hood, said second end of the lever being free; and a locking linkage having a first and a second end opposite to each other, said first end of the locking linkage engaging with said intermediate part of the lever, said second end of the locking linkage being for engaging with said second end of the cap.

3. A waterproof case as claimed in claim 2, wherein said first end of the locking linkage is rotatably held to said intermediate part of the lever, said close-keeping means further comprising a hook which is connected with said cap for locking said second end of the locking linkage.

4. A waterproof case as claimed in claim 1, wherein said cap mounting device comprises a mounting linkage having a first and a second end opposite to each other, said first end of the mounting linkage is rotatably held by said hood, said second end of the mounting linkage is rotatably held by said cap.

5. A waterproof case as claimed in claim 1, wherein said opening portion has a central axis extending in a predetermined direction, said waterproof case further comprising a sealing member placed around said opening portion, said sealing member being held between said hood and said cap in said predetermined direction when said opening portion is closed.

6. A waterproof case as claimed in claim 3, wherein said hood further comprises linkage holding means for holding said locking linkage to prevent said locking linkage from playing.

* * * * *